US010938118B2

(12) United States Patent
Takikawa et al.

(10) Patent No.: US 10,938,118 B2
(45) Date of Patent: Mar. 2, 2021

(54) RESONANT ELEMENT OF FREQUENCY SELECTIVE SURFACE, FREQUENCY SELECTIVE SURFACE AND ANTENNA DEVICE

(71) Applicant: Mitsubishi Electric Corporation, Chiyoda-ku (JP)

(72) Inventors: Michio Takikawa, Tokyo (JP); Hiroto Ado, Tokyo (JP); Masashi Okuno, Tokyo (JP); Yoshio Inasawa, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 166 days.

(21) Appl. No.: 16/080,170

(22) PCT Filed: Apr. 8, 2016

(86) PCT No.: PCT/JP2016/061559
§ 371 (c)(1),
(2) Date: Aug. 27, 2018

(87) PCT Pub. No.: WO2017/175386
PCT Pub. Date: Oct. 12, 2017

(65) Prior Publication Data

US 2019/0058258 A1 Feb. 21, 2019

(51) Int. Cl.
*H01Q 15/00* (2006.01)
*H01Q 15/16* (2006.01)
(Continued)

(52) U.S. Cl.
CPC ..... *H01Q 15/167* (2013.01); *H01Q 15/0013* (2013.01); *H01Q 15/02* (2013.01); *H01Q 15/14* (2013.01); *H01Q 15/147* (2013.01)

(58) Field of Classification Search
CPC ..... H01Q 15/00–15/16; H01Q 21/26
See application file for complete search history.

(56) References Cited

U.S. PATENT DOCUMENTS 5,861,860 A 1/1999 Stanek et al.
5,892,485 A * 4/1999 Glabe ..... H01Q 19/108 343/756
(Continued)

FOREIGN PATENT DOCUMENTS

CN 1200231 A 11/1996
JP 4-111603 A 4/1992
(Continued)

OTHER PUBLICATIONS

International Search Report dated Jun. 7, 2016 in PCT/JP2016/061559 filed Apr. 8, 2016.
(Continued)

*Primary Examiner* — Hasan Z Islam
(74) *Attorney, Agent, or Firm* — Oblon, McClelland, Maier & Neustadt, L.L.P.

(57) ABSTRACT

There are provided a plurality of poles whose roots are connected to a central part and whose tips extend in mutually different directions on an identical plane or on an identical curved surface, wherein a pole width at each of the roots is narrower than a pole width between each of the roots and the corresponding one of the tips, and a pole width at each of the tips is narrower that the pole width between each of the roots and the corresponding one of the tips, each pole width being defined by a length of a line segment in a direction perpendicular, on the identical plane or on the identical curved surface, to a line segment connecting each of the roots to a corresponding one of the tips in the respective poles.

5 Claims, 11 Drawing Sheets

(51) Int. Cl.
*H01Q 15/02* (2006.01)
*H01Q 15/14* (2006.01)

(56) References Cited

U.S. PATENT DOCUMENTS

| | | | | |
|---|---|---|---|---|
| 6,407,716 | B1 | 6/2002 | Strickland et al. | |
| 7,327,315 | B2 * | 2/2008 | Starkie | H01Q 5/00 343/700 MS |
| 8,017,217 | B1 | 9/2011 | Gregoire et al. | |
| 8,106,850 | B1 * | 1/2012 | Gregoire | H01Q 15/002 343/909 |
| 8,784,151 | B1 | 7/2014 | Gregoire et al. | |
| 9,368,879 | B1 * | 6/2016 | Manry, Jr. | H01Q 1/286 |
| 9,496,615 | B2 * | 11/2016 | Hsu | H01Q 5/378 |
| 2002/0140617 | A1 | 10/2002 | Luly et al. | |

FOREIGN PATENT DOCUMENTS

| | | | |
|---|---|---|---|
| JP | 5-14050 | A | 1/1993 |
| JP | 10-126091 | A | 5/1998 |
| JP | 2000-196288 | A | 7/2000 |
| JP | 2001-298322 | A | 10/2001 |
| WO | WO 2015/191141 | A2 | 12/2015 |
| WO | WO 2015/191141 | A3 | 12/2015 |

OTHER PUBLICATIONS

Makino, S., "[Tutorial Lecture] Basic Design Theory of Frequency Selective Reflector and its Applications," The Institute of Electronics, Information and Communication Engineers, A•P2015-5, Apr. 2015, 8 pages (with English Abstract).

Kraus,J.D. et al., "Antennas for All Applications," McGraw-Hill, 3rd Edition, 2002, 5 pages.

Extended European Search Report dated Mar. 13, 2019 in the corresponding European Application No. 16897942.5 9 pages.

Pereira, A. L., et al., "Investigation of Enhancement Band Using Double Screen Frequency Selective Surfaces with Koch Fractal Geometry at Millimeter Wave Range", Journal of Infrared, Millimeter, and Terahertz Waves, Springer US, Boston, vol. 31, No. 12, XP019863485, 2010, pp. 1503-1511.

Munk, B. A., "Aperiodicity: Is It a Good Idea?" In: Aperiodicity: Is It a Good Idea?, Wiley, XP055563446, 2005, pp. 242-268.

Combined Chinese Office Action and Search Report dated Mar. 20, 2020 in Chinese Patent Application No. 201680084231.2 (with unedited computer generated English translation). 19 pages.

Chinese Office Action dated Nov. 19, 2020 in corresponding application No. 201680084231.2 (with English translation, 12 pages).

* cited by examiner

RESONANT ELEMENT OF FREQUENCY SELECTIVE SURFACE, FREQUENCY SELECTIVE SURFACE AND ANTENNA DEVICE

TECHNICAL FIELD

The present invention relates to a frequency selective surface used as a spatial filter, a resonant element used for the frequency selective surface, and an antenna device mounting the frequency selective surface.

BACKGROUND ART

A frequency selective surface is used as, for example, a spatial filter such as a band-pass filter for transmitting only a radio wave having a desired frequency out of incoming radio waves, or a band-stop filter for reflecting only a radio wave of a desired frequency.

Thus, the frequency selective surface may be applied to, for example, a multi-frequency common reflector antenna, a communication system, a radar system, and the like, for applications such as radio wave interference prevention. The frequency selective surface is mainly classified into a patch-type frequency selective surface and a hole-type frequency selective surface.

The patch-type frequency selective surface has structure where a plurality of resonant elements, each being made of metal, is periodically arranged.

The hole-type frequency selective surface is made of a metal plate having a plurality of holes periodically provided. Each of the holes serves as a resonant element.

The following Non-Patent Literature 1 discloses a resonant element in which the roots of three poles are connected to the central part and the extending directions of the tips of the three poles are shifted by 120 degrees from each other. Each of the three poles of the resonant element is shaped in the form of rectangular.

CITATION LIST

Non-Patent Literature 1: J. D. Kraus, "Antennas", pp. 647-649, McGraw-Hill, 2002

SUMMARY OF INVENTION

When the frequency selective surface is applied to, for example, a reflector antenna, the incident direction of a radio wave to the frequency selective surface is not necessarily the front direction to the frequency selective surface, and an angle of incidence of the radio wave to the frequency selective surface may become large. Here, it is assumed that, when the incident direction of the radio wave is the front direction of the frequency selective surface, the incidence angle of the radio wave is 0 degrees, whereas the incidence angle becomes larger than 0 degrees as the incident direction shifts from the front direction.

An index for evaluating the characteristic of the frequency selective surface may be an incidence angle characteristic. It is desirable that a frequency selective surface is capable of obtaining a transmission characteristic and reflection characteristic over broadband even when the incidence angle of the radio wave becomes large.

In order to improve the incidence angle characteristic, it is necessary to densely arrange the plurality of resonant elements so that the interval between the central parts becomes narrow.

In addition, it is necessary to widen the area of the pole in order to increase the bandwidth of the resonant element. When the shape of the pole is rectangular, under the condition where the pole length in the longitudinal direction of the rectangle is constant, it is necessary to widen the pole width in the lateral direction of the rectangle. Here it is assumed that the pole length is constant because the resonance frequency of the resonant element may change when the pole length is changed.

When the plurality of resonant elements, each having rectangular poles whose width is wide, is brought close to each other, the tip of the pole in each resonant element is likely to come into contact with the other resonant element. Therefore, it is impossible to densely arrange the plurality of resonant elements, and there has been a problem that it is difficult to improve the incidence angle characteristic.

The present invention has been made to solve the above problem. An object of the present invention is to obtain a resonant element of a frequency selective surface, the resonant element being able to be arranged close to other resonant elements within a range not contacting other resonant elements.

In addition, an object of the present invention is to obtain a frequency selective surface capable of obtaining the transmission characteristic and the reflection characteristic over broadband even when the incidence angle of the radio wave becomes large.

In addition, an object of the present invention is to obtain an antenna device mounting the frequency selective surface capable of obtaining the transmission characteristic and the reflection characteristic over broadband even when the incidence angle of the radio wave becomes large.

A resonant element of a frequency selective surface according to the present invention includes: a plurality of poles whose roots are connected to a central part and whose tips extend in mutually different directions on an identical plane or on an identical curved surface, wherein a pole width at each of the roots is narrower than a pole width between each of the roots and the corresponding one of the tips, and a pole width at each of the tips is narrower than the pole width between each of the roots and the corresponding one of the tips, each pole width being defined by a length of a line segment in a direction perpendicular, on the identical plane or on the identical curved surface, to a line segment connecting each of the roots to a corresponding one of the tips in the respective poles.

According to the present invention, a pole width at each of the roots is narrower than a pole width between each of the roots and the corresponding one of the tips, and a pole width at each of the tips is narrower than the pole width between each of the roots and the corresponding one of the tips, each pole width being defined by a length of a line segment in a direction perpendicular, on the identical plane or on the identical curved surface, to a line segment connecting each of the roots to a corresponding one of the tips in the respective poles. Therefore, there is an effect that the resonant element can be arranged close to other resonant elements within the range not contacting other resonant elements.

DESCRIPTION OF EMBODIMENTS

Hereinafter, in order to explain the present invention in more detail, embodiments for carrying out the present invention will be described with reference to the accompanying drawings.

Embodiment 1

Figure 1:
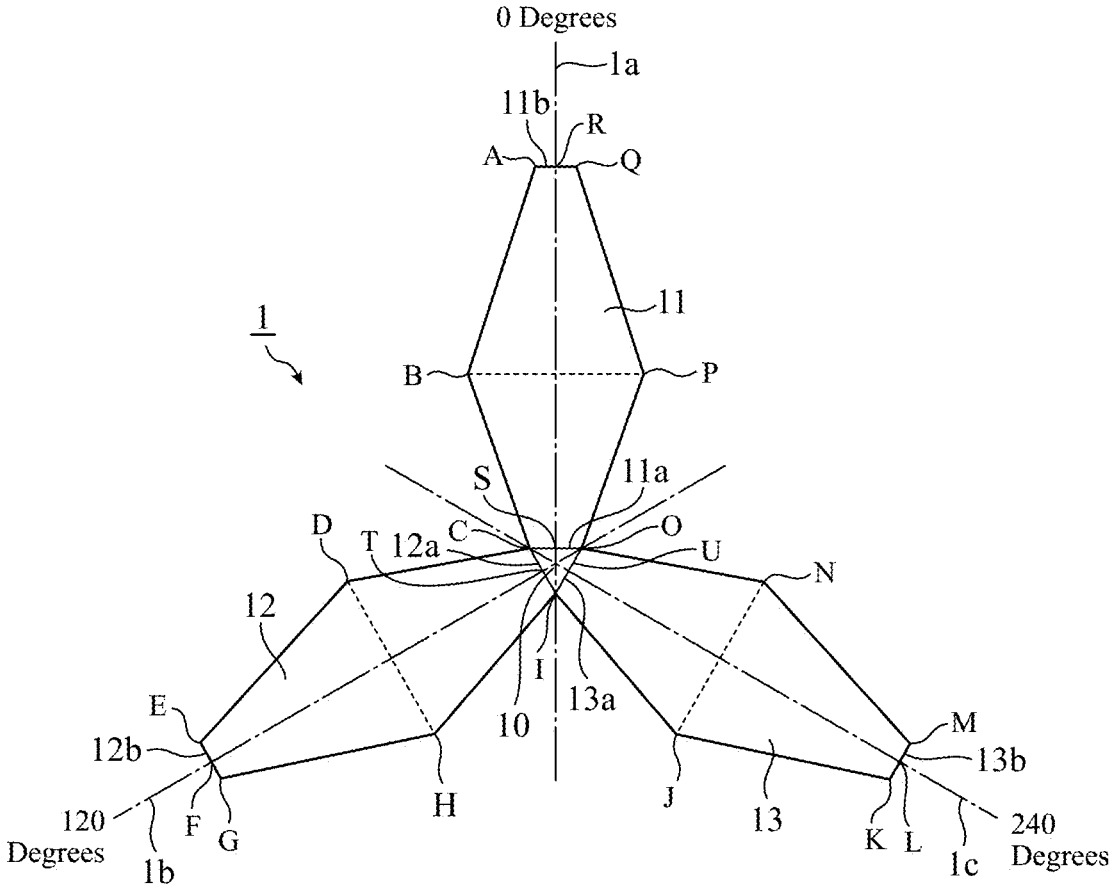
FIG. 1 is a structural diagram of a resonant element of a frequency selective surface according to Embodiment 1 of the present invention.
Figure 2:
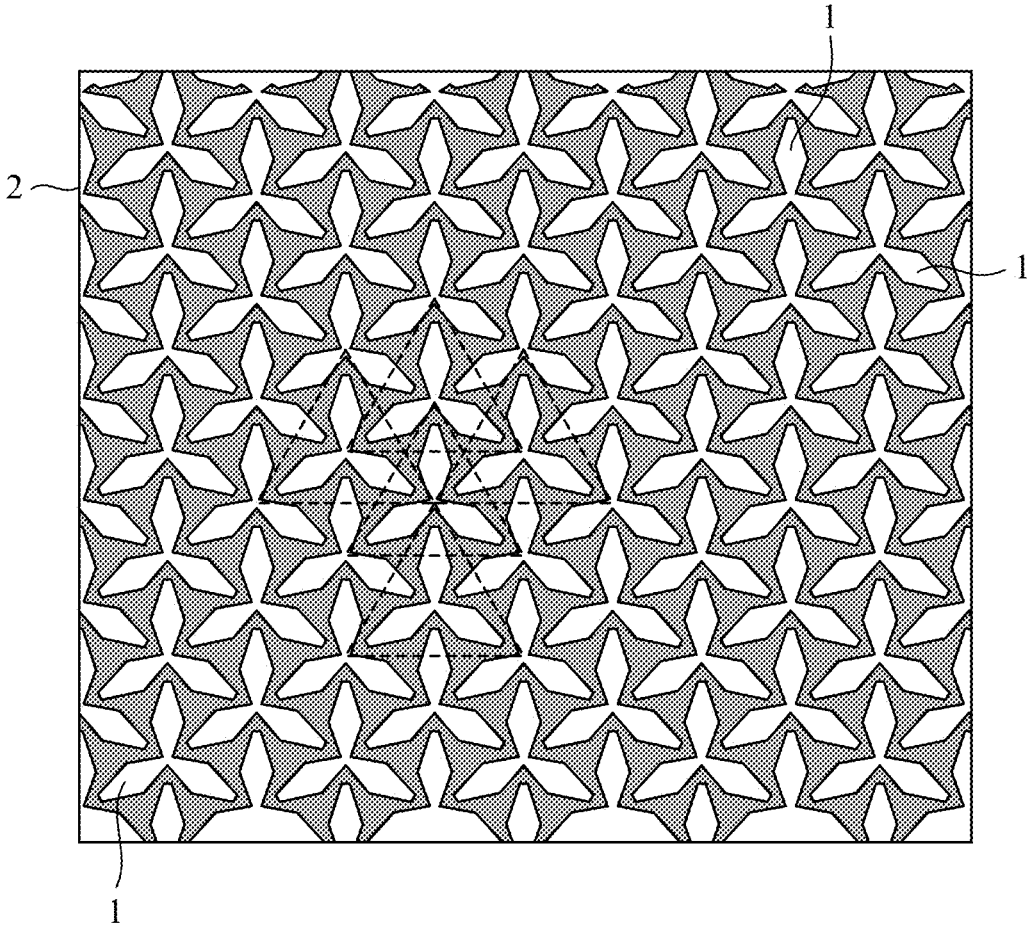
FIG. 2 is a structural diagram of the frequency selective surface according to the Embodiment 1 of the present invention.

FIG. 1 is a structural diagram of a resonant element of a frequency selective surface according to the Embodiment 1 of the present invention, and FIG. 2 is a structural diagram of the frequency selective surface according to the Embodiment 1 of the present invention.

In the Embodiment 1, an example will be described, in which the frequency selective surface is a hole-type frequency selective surface.

The hole-type frequency selective surface is made of a metal plate 2 having a plurality of holes periodically applied thereto.

In the hole-type frequency selective surface, the holes provided in the metal plate 2 serve as resonant elements. In the Embodiment 1, it is assumed that the holes applied in the metal plate 2 are the resonant elements.

In the Embodiment 1, the shape of each hole in the hole-type frequency selective surface coincides with the shape of the resonant element 1 of FIG. 1.

In FIGS. 1 and 2, central axes 1*a*, 1*b*, and 1*c* are axes of the resonant element 1 arranged at an interval of 120 degrees.

A central part 10 is a part that is positioned at the center of the resonant element 1.

In the example of FIG. 1, since three poles 11, 12, and 13 are connected to the central part 10, the shape of the central part 10 is a triangle. The three central axes 1*a*, 1*b*, and 1*c* cross each other at the central point of the central part 10.

In FIG. 1, for convenience of description, while the upper side of the sheet is the reference position, a direction from the central part 10 to the upper side of the sheet is represented as 0 degrees, a direction to the lower left side of the sheet is represented as 120 degrees, and a direction to the lower right side of the sheet is represented as 240 degrees.

A to U are signs indicating positions of respective points on the resonant element 1.

The metal plate 2 is a flat plate having a flat surface. In the metal plate 2, the holes, each being the resonant element 1 of FIG. 1, are periodically arranged.

An arrangement pattern of the resonant elements 1 is formed such that, as illustrated in FIG. 2, when attention is paid to two resonant elements 1 arranged at adjacent positions among the plurality of resonant elements 1, the tip of one of the poles in one of the two resonant elements 1 is close to the central part 10 of another one of the two resonant elements 1 within a range not contacting another one of the two resonant elements 1.

In the pole 11, a root 11*a* is connected to the central part 10, and a tip 11*b* extends in the direction of 0 degrees.

The pole 11 is arranged on the central axis 1*a* and has a line-symmetrical shape with the central axis 1*a* as the axis of symmetry.

In the pole 12, a root 12*a* is connected to the central part 10, and a tip 12*b* extends in the direction of 120 degrees.

The pole 12 is arranged on the central axis 1*b* and has a line-symmetrical shape with the central axis 1*b* as the axis of symmetry.

In the pole 13, a root 13*a* is connected to the central part 10, and a tip 13*b* extends in the direction of 240 degrees.

The pole 13 is arranged on the central axis 1*c* and has a line-symmetrical shape with the central axis 1*c* as the axis of symmetry.

In FIG. 2, since the metal plate 2 is a flat plate, the tips 11*b*, 12*b*, and 13*b* of the respective poles 11, 12, and 13 extend in mutually different directions on the identical plane. Specifically, the extending directions of the tips 11*b*, 12*b*, and 13*b* of the respective poles 11, 12, and 13 are shifted by 120 degrees from each other.

In FIG. 1, the resonant element 1 includes the three poles 11, 12, and 13. Alternatively, the resonant element 1 may include four or more poles.

When the resonant element 1 includes, for example, four poles, the resonant element 1 has a shape in which the extending directions of the tips of the four poles are shifted by 90 degrees from each other. As another example, when the resonant element 1 includes five poles, the resonant element 1 has a shape in which the extending directions of the tips of the five poles are shifted by 72 degrees from each other.

In the pole 11, the pole width at the root 11*a* is narrower than the pole width between the root 11*a* and the tip 11*b*. The pole width is the length of the line segment in a direction perpendicular, on the identical plane, to the line segment connecting the root 11*a* to the tip 11*b* in the pole 11. In addition, the pole width at the tip 11*b* is narrower than the pole width between the root 11*a* and the tip 11*b*.

Specifically, a line segment connecting a point R to a point S (hereinafter referred to as "line segment RS") corresponds to a line segment connecting the root 11*a* to the tip 11*b* in the pole 11.

For example, a line segment connecting a point A to a point Q (hereinafter referred to as "line segment AQ"), a line segment connecting a point C to a point O (hereinafter referred to as "line segment CO"), and a line segment connecting a point B to a point P (hereinafter referred to as "line segment BP") each correspond to a line segment in a direction perpendicular to the line segment RS.

The length of the line segment CO corresponds to the pole width at the root 11*a*, the length of the line segment AQ corresponds to the pole width at the tip 11*b*, and the length of the line segment BP corresponds to the pole width between the root 11*a* and the tip 11*b*. Hereinafter, the length of the line segment BP is referred to as the pole width of the middle part of the pole 11.

The length of the line segment CO and the length of the line segment AQ are shorter than the length of the line segment BP.

In the pole 12, the pole width at the root 12*a* is narrower than the pole width between the root 12*a* and the tip 12*b*. The pole width is the length of the line segment in a direction perpendicular, on the identical plane, to the line segment connecting the root 12*a* to the tip 12*b* in the pole 12. In addition, the pole width at the tip 12*b* is narrower than the pole width between the root 12*a* and the tip 12*b*.

Specifically, a line segment connecting a point F to a point T (hereinafter referred to as "line segment FT") corresponds to a line segment connecting the root 12*a* to the tip 12*b* in the pole 12.

For example, a line segment connecting a point E to a point G (hereinafter referred to as "line segment EG"), a line segment connecting the point C to a point I (hereinafter referred to as "line segment CI"), and a line segment connecting a point D to a point H (hereinafter referred to as "line segment DH") each correspond to a line segment in a direction perpendicular to the line segment FT.

The length of the line segment CI corresponds to the pole width at the root 12*a*, the length of the line segment EG corresponds to the pole width at the tip 12*b*, and the length of the line segment DH corresponds to the pole width between the root 12*a* and the tip 12*b*. Hereinafter, the length of the line segment DH is referred to as the pole width of the middle part of the pole 12.

The length of the line segment CI and the length of the line segment EG are shorter than the length of the line segment DH.

In the pole 13, the pole width at the root 13*a* is narrower than the pole width between the root 13*a* and the tip 13*b*. The pole width is the length of the line segment in a direction perpendicular, on the identical plane, to the line segment connecting the root 13*a* to the tip 13*b* in the pole 13. In addition, the pole width at the tip 13*b* is narrower than the pole width between the root 13*a* and the tip 13*b*.

Specifically, a line segment connecting a point L to a point U (hereinafter referred to as "line segment LU") corresponds to a line segment connecting the root 13*a* to the tip 13*b* in the pole 13.

For example, a line segment connecting a point K to a point M (hereinafter referred to as "line segment KM"), a line segment connecting the point I to the point O (hereinafter referred to as "line segment 10"), and a line segment connecting a point J to a point N (hereinafter referred to as "line segment JN") each correspond to a line segment in a direction perpendicular to the line segment LU.

The length of the line segment IO corresponds to the pole width at the root 13*a*, the length of the line segment KM corresponds to the pole width at the tip 13*b*, and the length of the line segment JN corresponds to the pole width between the root 13*a* and the tip 13*b*. Hereinafter, the length of the line segment JN is referred to as the pole width of the middle part of the pole 13.

The length of the line segment IO and the length of the line segment KM are shorter than the length of the line segment JN.

Therefore, in the poles 11, 12, and 13 of the resonant element 1 of FIG. 1, the pole width at each of the root 11*a*, 12*a*, and 13*a* is narrower than the pole width at the corresponding middle part. In addition, the pole width at each of the tips 11*b*, 12*b*, and 13*b* is narrower than the pole width at the corresponding middle part.

For this reason, the resonant element 1 has a wedge shape in which the central part 10 is constricted, and the tips 11*b*, 12*b*, and 13*b* of the respective poles 11, 12, and 13 are tapered.

Since the pole width of the middle part is widened, even when the pole widths at the root 11*a*, 12*a*, and 13*a* and the pole widths at the tip 11*b*, 12*b*, and 13*b* are narrow, a large area can be secured in the entire poles 11, 12, and 13.

Next, the operation will be described.

The operating principle of the hole-type frequency selective surface will be briefly described.

When a radio wave is incident on a metal plate on which the holes serving as the resonant elements 1 are not provided, the radio wave is completely reflected by the metal plate. For this reason, the incident radio wave has a reflection coefficient of "−1" and a transmission coefficient of "0". The reflection coefficient of "−1" means that all the incident radio waves are reflected, and the transmission coefficient of "0" means that there is no radio wave to be transmitted.

On the other hand, when a radio wave is incident on the hole-type frequency selective surface on which the holes as the resonant elements 1 are provided, the radio wave generates an electric field in each of the holes as the resonant elements 1. As a result, a magnetic current is induced in each of the resonant elements 1.

Due to the inducement of the magnetic current, a scattered wave is propagated to both the incident side and the transmission side of the radio wave in the hole-type frequency selective surface.

The magnitude of the scattered wave propagated depends on the magnitude of the magnetic current induced in the resonant element 1. When the resonant element 1 completely resonates, a scattering coefficient thereof is "1". The scattering coefficient "1" means a radio wave of the same magnitude in the direction opposite to the reflected wave of the incident radio wave.

As a result, on the incident side, the scattered wave propagated to the incident side and the reflected wave being the radio wave reflected by the metal portion of the hole-type frequency selective surface are canceled each other, and the reflection component is "0". Thus, the radio wave incident on the hole-type frequency selective surface is transmitted with a transmission coefficient of "1". The transmission coefficient "1" means that all the incident radio waves are transmitted.

Accordingly, when the resonant element 1 completely resonates, the hole-type frequency selective surface operates as a band-pass filter whose transmission coefficient is "1".

For improving the incidence angle characteristic of the frequency selective surface, it is necessary to densely arrange the plurality of resonant elements 1 in order to narrow the interval between the central parts 10 of the resonant elements 1.

In FIG. 2, the plurality of resonant elements 1 is arranged with an arrangement pattern called a triangular arrangement.

In the triangular arrangement, the resonant element 1 is arranged at each vertex of an equilateral triangle, and equilateral triangles, each including the resonant element 1 arranged at each vertex, are periodically arranged.

In FIG. 2, the equilateral triangle is highlighted by a broken line, and a plurality of the equilateral triangles is arranged to be mingled with each other. In FIG. 2, for simplicity of the drawing, only four equilateral triangles are highlighted by broken lines.

When attention is paid to a specific resonant element 1 among the plurality of resonant elements 1 in the triangular arrangement, the tip of the pole in the specific resonant element 1 is arranged near a constricted portion in the central part 10 of an adjacent resonant element 1.

The shape of the central part 10 of the resonant element 1 of the Embodiment 1 is a wedge shape having the constricted portion.

In the Embodiment 1, as compared with a resonant element in which the shape of the pole is rectangular, the tip of the pole can be brought close to the central part 10 of the adjacent resonant element 1 by an amount corresponding to the constricted portion without contacting the adjacent resonant element 1.

As a result, even when the incidence angle of the radio wave becomes large, it is capable of obtaining a transmission characteristic and reflection characteristic over broadband.

Figure 3:
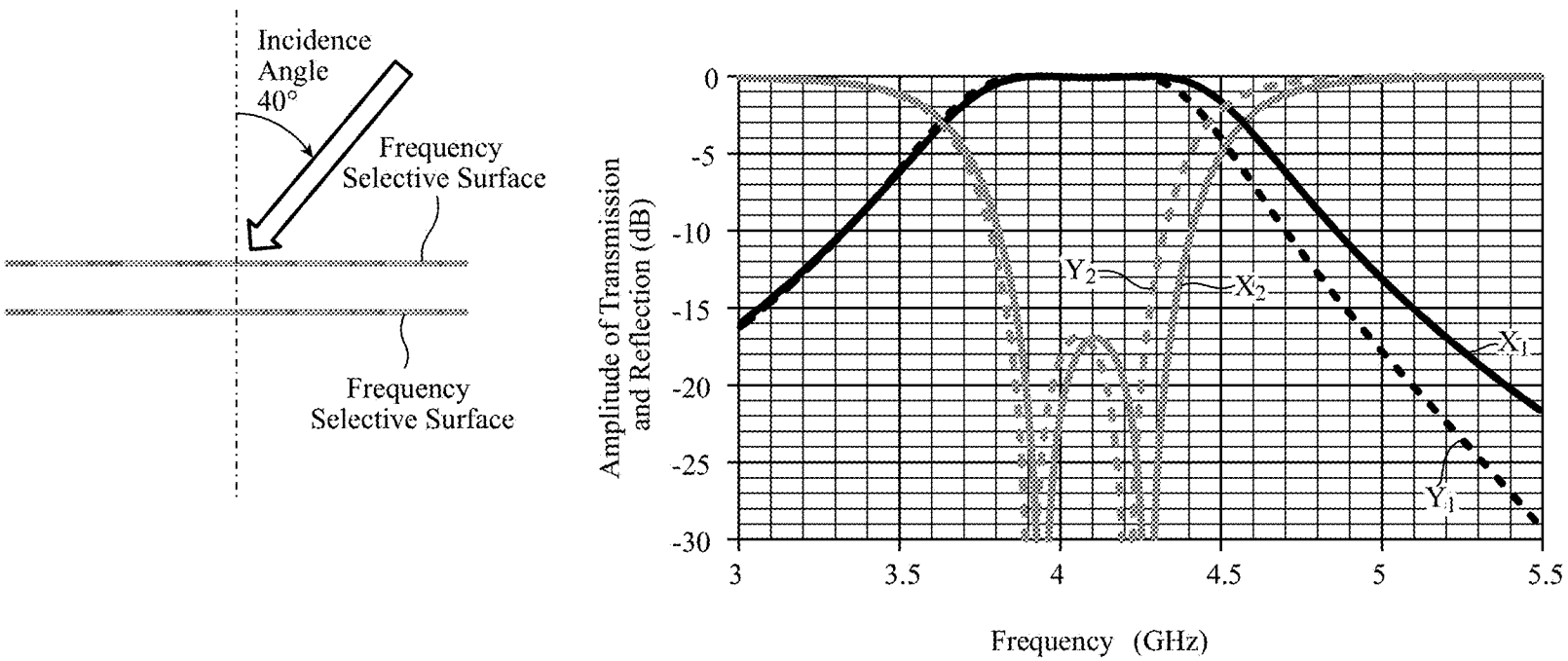
FIG. 3 is an explanatory diagram of a transmission characteristic and a reflection characteristic of a hole-type frequency selective surface.

FIG. 3 is an explanatory diagram of the transmission characteristic and the reflection characteristic of the hole-type frequency selective surface.

In FIG. 3, a two-layer structure is illustrated, in which two frequency selective surfaces shown in FIG. 2 are stacked as the hole-type frequency selective surface of the Embodiment 1. In addition, the transmission characteristic and the reflection characteristic are illustrated with an assumption that the incidence angle of the radio wave is 40 degrees.

In FIG. 3, for comparing with the hole-type frequency selective surface of the Embodiment 1, the transmission characteristic and the reflection characteristic of a hole-type frequency selective surface are also illustrated, in which holes as resonant elements are formed by rectangular poles and are periodically provided (hereinafter referred to as "a conventional hole-type frequency selective surface").

Note that the conventional hole-type frequency selective surface is dimensionally optimized such that the transmission characteristic and the reflection characteristic at the incidence angle of 0 degrees are the same as those of the hole-type frequency selective surface of the Embodiment 1.

In addition, similarly to the case of the hole-type frequency selective surface of the Embodiment 1, the conventional hole-type frequency selective surface is assumed to have a two-layer structure, and the transmission characteristic and the reflection characteristic are illustrated with an assumption that the incidence angle of the radio wave is 40 degrees.

In FIG. 3, $X_1$ indicates the transmission characteristic of the hole-type frequency selective surface of the Embodiment 1, and $X_2$ indicates the reflection characteristic of the hole-type frequency selective surface of the Embodiment 1.

In addition, $Y_1$ indicates the transmission characteristic of the conventional hole-type frequency selective surface, and $Y_2$ indicates the reflection characteristic of the conventional hole-type frequency selective surface.

When attention is paid to the transmission characteristic, at the radio wave frequency of around 3 GHz to 4.3 GHz, the transmission characteristic $X_1$ of the hole-type frequency selective surface of the Embodiment 1 is approximately the same as the transmission characteristic $Y_1$ of the conventional hole-type frequency selective surface.

In contrast, at the radio wave frequency of around 4.3 GHz or higher, the transmission loss of the hole-type frequency selective surface of the Embodiment 1 is smaller than the transmission loss of the conventional hole-type frequency selective surface. For instance, at the radio wave frequency of around 5.5 GHz, the transmission loss of the hole-type frequency selective surface of the Embodiment 1 is about −22 dB, whereas the transmission loss of the conventional hole-type frequency selective surface is about −30 dB.

Therefore, as compared with the conventional hole-type frequency selective surface, a wider broadband transmission characteristic can be achieved in the hole-type frequency selective surface of the Embodiment 1.

On the other hand, when attention is paid to the reflection characteristic, at the radio wave frequency of around 3.6 GHz to 3.9 GHz and around 4.1 GHz to 4.2 GHz, the reflection loss of the hole-type frequency selective surface of the Embodiment 1 is slightly smaller than the reflection loss of the conventional hole-type frequency selective surface. In contrast, at the radio wave frequency of around 3.9 GHz to 4.1 GHz and around 4.2 GHz to 5 GHz, the reflection loss of the hole-type frequency selective surface of the Embodiment 1 is considerably larger than the reflection loss of the conventional hole-type frequency selective surface.

Therefore, as compared with the conventional hole-type frequency selective surface, a wider broadband reflection characteristic can be achieved in the hole-type frequency selective surface of the Embodiment 1.

Although FIG. 3 illustrates the example of the two-layer structure in which two hole-type frequency selective surfaces are stacked, even in the case of a multilayer structure in which three or more hole-type frequency selective surfaces are stacked to be used, or in the case of a single layer structure in which only one hole-type frequency selective surface is used, the transmission characteristic and the reflection characteristic over broadband can be obtained, as in the case of the two-layer structure.

As is apparent from the above description, according to the Embodiment 1, there are provided the poles 11, 12, and 13 whose roots 11*a*, 12*a*, and 13*a* are connected to the central part 10 and whose tips 11*b*, 12*b*, and 13*b* extend in mutually different directions on an identical plane or on an identical curved surface. A pole width at each of the roots 11*a*, 12*a*, and 13*a* is narrower than a pole width between each of the roots 11*a*, 12*a*, and 13*a* and the corresponding one of the tips 11*b*, 12*b*, and 13*b*, each pole width being defined by a length of a line segment in a direction perpendicular, on the identical plane or on the identical curved surface, to a line segment connecting each of the roots 11*a*, 12*a*, and 13*a* to a corresponding one of the tips 11*b*, 12*b*, and 13*b* in the respective poles 11, 12, and 13. Therefore, it is possible to obtain the resonant element 1 that can be arranged close to other resonant elements 1 within a range not contacting the other resonant elements 1.

As a result, even when the incidence angle of the radio wave becomes large, it is possible to obtain a frequency selective surface capable of obtaining the transmission characteristic and the reflection characteristic over broadband.

In the Embodiment 1, although the resonant element 1 is shaped as illustrated in FIG. 1, the shape of the central part 10 of the resonant element 1 can be modified so long as it is a wedge shape having the constricted portion.

FIG. 4 is an explanatory diagram of modifications of the resonant element 1 illustrated in FIG. 1.

Figure 4A:
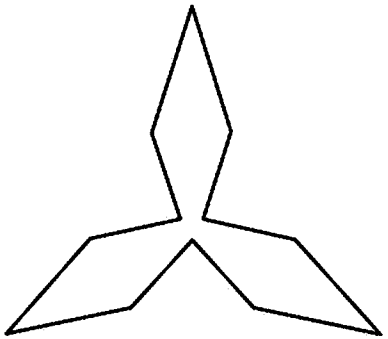
FIG. 4A is an explanatory diagram of a resonant element 1 in which the tips of poles 11, 12, and 13 are sharp.

FIG. 4A illustrates the resonant element 1 in which the tips 11*b*, 12*b*, and 13*b* of the respective poles 11, 12, and 13 are sharp.

Figure 4B:
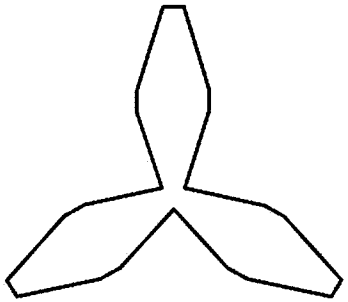
FIG. 4B is an explanatory diagram of a resonant element 1 in which there are parallel portions between the roots and the tips in the poles 11, 12, and 13.

FIG. 4B illustrates the resonant element 1 in which there are parallel portions between the roots 11*a*, 12*a*, and 13*a* and the respective tips 11*b*, 12*b*, and 13*b* in the poles 11, 12, and 13.

That is, in the resonant element 1 illustrated in FIG. 1, for example, the point B and the point P are angular, whereas, in the resonant element 1 illustrated in FIG. 4B, a part corresponding to the point B and a part corresponding to the point P are parallel to each other.

Figure 4C:
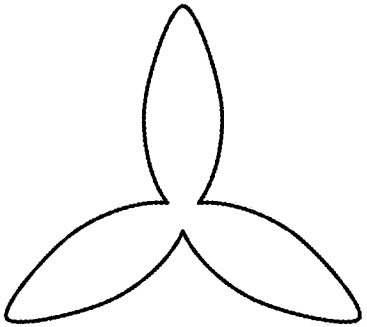
FIG. 4C is an explanatory diagram of a resonant element 1 in which the roots and the tips of the poles 11, 12, and 13 are formed in smooth curved shapes.

FIG. 4C illustrates the resonant element 1 in which the roots and the tips of the poles 11, 12, and 13 are formed in smooth curved shapes.

In the Embodiment 1, the example has been described in which the arrangement pattern of the plurality of resonant elements 1 is the triangular arrangement. However, the arrangement pattern is not limited to that example so long as the plurality of resonant elements 1 are densely arranged to narrow the interval between the central parts 10 of the resonant elements 1. For example, the arrangement pattern of the plurality of resonant elements 1 may be a rectangular arrangement.

Figure 5:
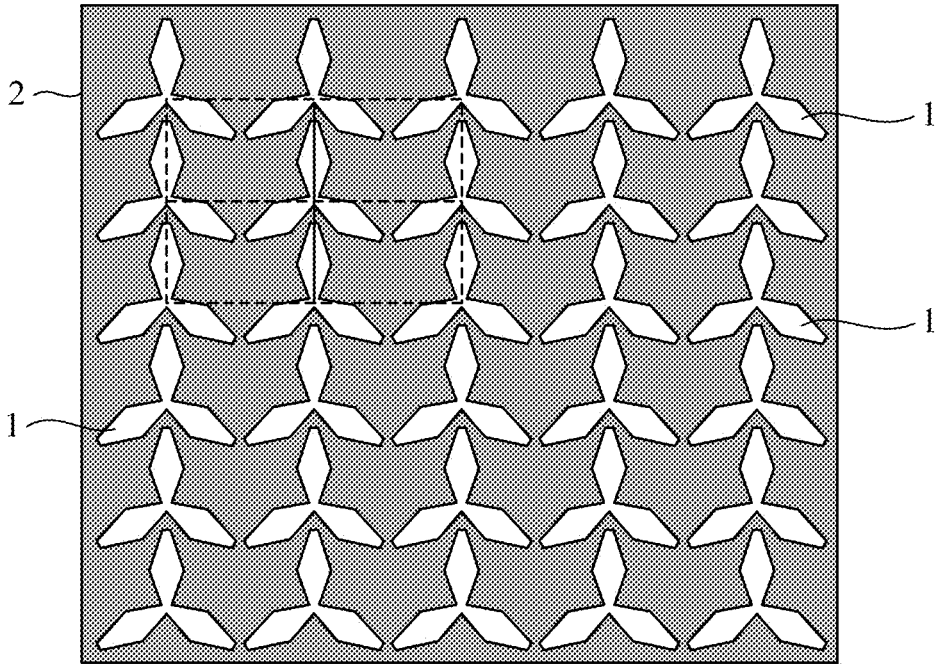
FIG. 5 is an explanatory diagram of a rectangular arrangement of a plurality of the resonant elements 1.

FIG. 5 is an explanatory diagram of an example in which the arrangement pattern of the plurality of resonant elements 1 is the rectangular arrangement.

In the rectangular arrangement, the resonant element 1 is arranged at each vertex of a rectangle, and rectangles are periodically arranged, each including the resonant element 1 arranged at each vertex.

In FIG. 5, the rectangle is highlighted by a broken line, and a plurality of the rectangles is arranged. In FIG. 5, for simplicity of the drawing, only four rectangles are highlighted by broken lines.

When attention is paid to a certain resonant element 1 among the plurality of resonant elements 1 arranged in a rectangle, the tip of one of the poles in the resonant element 1 is arranged near the constricted portion in the central part 10 of the adjacent resonant element 1.

Since the plurality of resonant elements 1 is densely arranged, even when the incidence angle of the radio wave becomes large, it is capable of obtaining the transmission characteristic and the reflection characteristic over broadband.

Embodiment 2

The foregoing Embodiment 1 discloses the example in which the frequency selective surface of FIG. 2 is a hole-type frequency selective surface. In the Embodiment 2, a case will be described, in which the frequency selective surface of FIG. 2 is a patch-type frequency selective surface.

When the frequency selective surface of FIG. 2 is the patch-type frequency selective surface, the metal section and the hole section are reversed.

That is, the resonant element 1 of FIG. 1 that is made of metal is arranged in the hole section of FIG. 2, and the metal section of FIG. 2 is empty.

Hereinafter, the operating principle of the patch-type frequency selective surface will be briefly described.

In a space where the patch-type frequency selective surface does not exist, the radio wave is transmitted as it is. In this case, the reflection coefficient is "0" and the transmission coefficient is "1". The reflection coefficient "0" means that there is no radio wave to be reflected.

On the other hand, when a radio wave is incident on the patch-type frequency selective surface on which the resonant elements 1 are arranged, a current is induced in each of the resonant elements 1 by the radio wave.

By the inducement of the current, a scattered wave is propagated to both the incident side and the transmission side of the radio wave in the patch-type frequency selective surface.

The magnitude of the scattered wave propagated depends on the magnitude of the current induced in the resonant element 1. When the resonant element 1 completely resonates, a scattering coefficient thereof is "−1". The scattering coefficient "−1" means a radio wave of the same magnitude in the direction opposite to the transmitted wave of the incident radio wave.

As a result, on the transmission side, the scattered wave propagated to the transmission side and the transmitted wave that is the radio wave transmitted through the space between the plurality of resonant elements 1 in the patch-type frequency selective surface are canceled each other, and the transmission component is "0". Thus, the radio wave incident on the patch-type frequency selective surface is reflected with a reflection coefficient of "−1".

As a result, when the resonant element 1 completely resonates, the patch-type frequency selective surface operates as a band-stop filter whose reflection coefficient is "−1".

Figure 6:
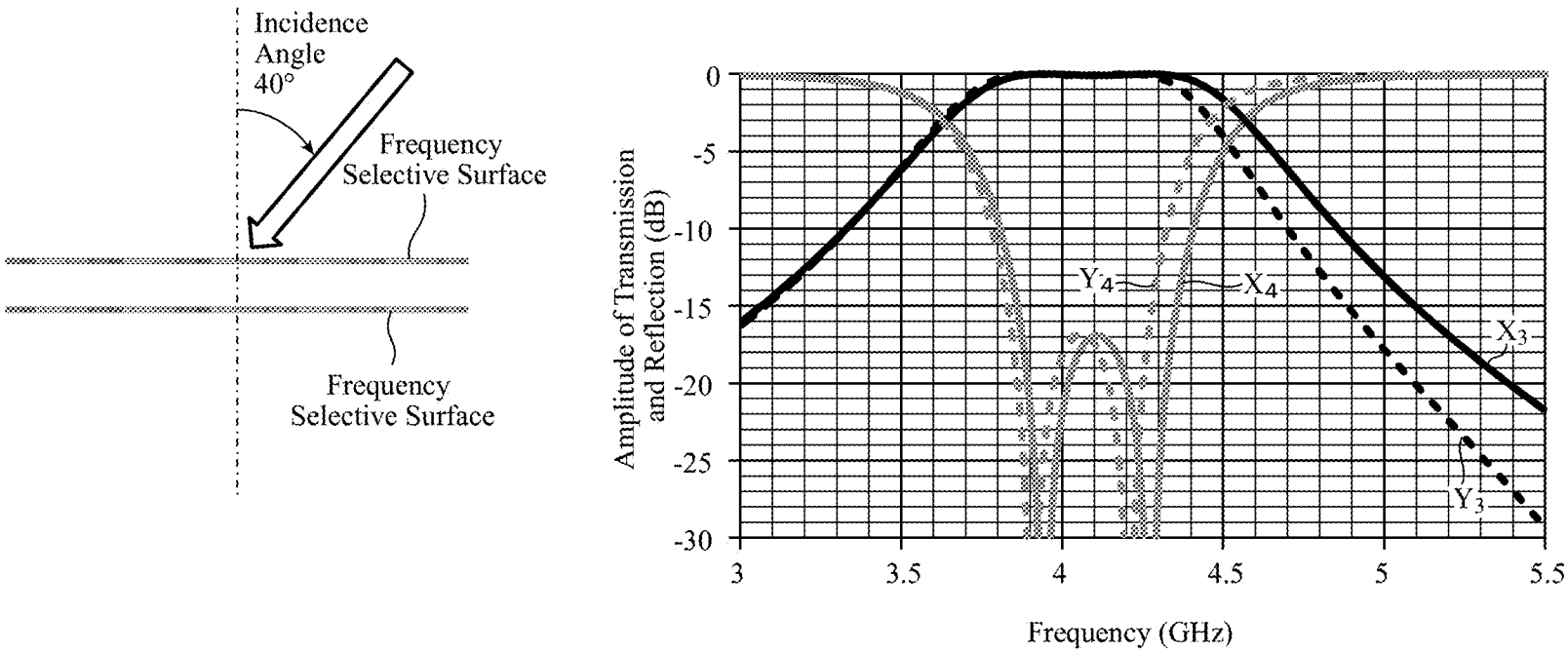
FIG. 6 is an explanatory diagram of a transmission characteristic and a reflection characteristic of a patch-type frequency selective surface.

FIG. 6 is an explanatory diagram of the transmission characteristic and the reflection characteristic of the patch-type frequency selective surface.

In FIG. 6, a two-layer structure is illustrated, in which two frequency selective surfaces shown in FIG. 2 are stacked as the patch-type frequency selective surface of the Embodiment 2. In addition, the transmission characteristic and the reflection characteristic are illustrated with an assumption that the incidence angle of the radio wave is 40 degrees.

In FIG. 6, for comparing with the patch-type frequency selective surface of the Embodiment 2, the transmission characteristic and the reflection characteristic of a patch-type frequency selective surface are also illustrated, in which resonant elements including rectangular poles are periodically arranged (hereinafter referred to as "a conventional patch-type frequency selective surface").

Note that the conventional patch-type frequency selective surface is dimensionally optimized such that the transmission characteristic and the reflection characteristic at the incidence angle of 0 degrees are the same as those of the patch-type frequency selective surface of the Embodiment 2.

In addition, similarly to the case of the patch-type frequency selective surface of the Embodiment 2, the conventional patch-type frequency selective surface is assumed to have a two-layer structure, and the transmission characteristic and the reflection characteristic are illustrated with an assumption that the incidence angle of the radio wave is 40 degrees.

In FIG. 6, $X_3$ indicates the reflection characteristic of the patch-type frequency selective surface of the Embodiment 2, and $X_4$ indicates the transmission characteristic of the patch-type frequency selective surface of the Embodiment 2.

In addition, $Y_3$ indicates the reflection characteristic of the conventional patch-type frequency selective surface, and $Y_4$ indicates the transmission characteristic of the conventional patch-type frequency selective surface.

When attention is paid to the reflection characteristic, at the radio wave frequency of around 3 GHz to 4.3 GHz, the reflection characteristic $X_3$ of the patch-type frequency selective surface of the Embodiment 2 is approximately the same as the reflection characteristic $Y_3$ of the conventional patch-type frequency selective surface.

In contrast, at the radio wave frequency of around 4.3 GHz or higher, the reflection loss of the patch-type frequency selective surface of the Embodiment 2 is smaller than the reflection loss of the conventional patch-type frequency selective surface. For instance, at the radio wave frequency of about 5.5 GHz, the reflection loss of the patch-type frequency selective surface of the Embodiment 2 is about −22 dB, whereas the reflection loss of the conventional patch-type frequency selective surface is about −30 dB.

Therefore, as compared with the conventional patch-type frequency selective surface, a wider broadband reflection characteristic is achieved in the patch-type frequency selective surface of the Embodiment 2.

On the other hand, when attention is paid to the transmission characteristic, at the radio wave frequency of around 3.6 GHz to 3.9 GHz and around 4.1 GHz to 4.2 GHz, the transmission loss of the patch-type frequency selective surface of the Embodiment 2 is slightly smaller than the transmission loss of the conventional patch-type frequency selective surface. In contrast, at the radio wave frequency of around 3.9 GHz to 4.1 GHz and around 4.2 GHz to 5 GHz, the transmission loss of the patch-type frequency selective surface of the Embodiment 2 is considerably larger than the transmission loss of the conventional patch-type frequency selective surface.

Therefore, as compared with the conventional patch-type frequency selective surface, a wider broadband transmission characteristic is achieved in the patch-type frequency selective surface of the Embodiment 2.

Although FIG. 6 illustrates the example of the two-layer structure in which two patch-type frequency selective surfaces are stacked, even in the case of a multilayer structure in which three or more patch-type frequency selective surfaces are stacked to be used, or in the case of a single layer structure in which only one patch-type frequency selective surface is used, the transmission characteristic and the reflection characteristic over broadband can be obtained, as in the case of the two-layer structure.

As is apparent from the above description, according to the Embodiment 2, there are provided the poles 11, 12, and 13 whose roots 11*a*, 12*a*, and 13*a* are connected to the central part 10 and whose tips 11*b*, 12*b*, and 13*b* extend in mutually different directions on an identical plane or on an identical curved surface. A pole width at each of the roots 11*a*, 12*a*, and 13*a* is narrower than a pole width between each of the roots 11*a*, 12*a*, and 13*a* and the corresponding one of the tips 11*b*, 12*b*, and 13*b*, each pole width being defined by a length of a line segment in a direction perpendicular, on the identical plane or on the identical curved surface, to a line segment connecting each of the roots 11*a*, 12*a*, and 13*a* to a corresponding one of the tips 11*b*, 12*b*, and 13*b* in the respective poles 11, 12, and 13. Therefore, it is possible to obtain the resonant element 1 that can be arranged close to other resonant elements 1 within a range not contacting the other resonant elements 1.

Therefore, even when the incidence angle of the radio wave becomes large, it is possible to obtain a frequency selective surface capable of obtaining the transmission characteristic and the reflection characteristic over broadband.

Embodiment 3

In each of foregoing Embodiments 1 and 2, the frequency selective surface has been described, in which the plurality of resonant elements 1 is arranged on the flat metal plate 2. In Embodiment 3, a frequency selective surface will be described, in which the plurality of resonant elements 1 is arranged on a metal plate 2 that is a curved plate whose surface is curved.

FIG. 7 is a structural diagram of the frequency selective surface according to the Embodiment 3 of the present invention.

Figure 7A:
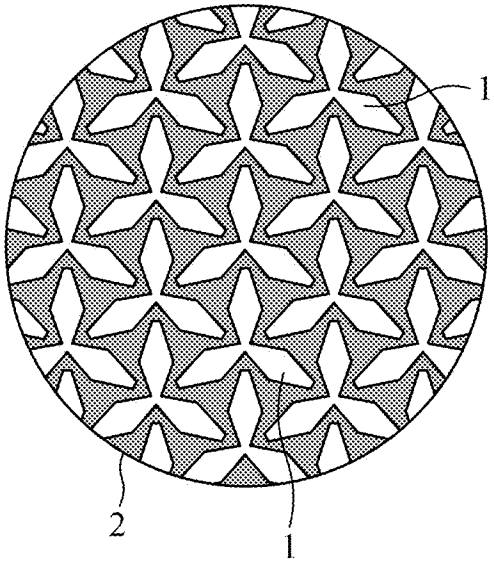
FIG. 7A is a diagram of a top view of a frequency selective surface according to Embodiment 3 of the present invention.
Figure 7B:
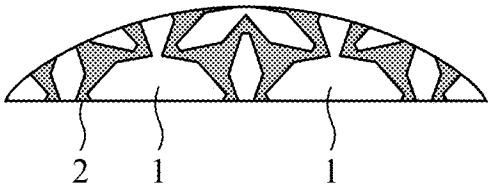
FIG. 7B is a diagram of a side view of the frequency selective surface according to the Embodiment 3 of the present invention.

Specifically, FIG. 7A is a diagram of a top view of a frequency selective surface according to Embodiment 3 of the present invention, and FIG. 7B is a diagram of a side view of the frequency selective surface according to the Embodiment 3.

The frequency selective surface illustrated in FIG. 7 may be the hole-type frequency selective surface or the patch-type frequency selective surface.

In FIG. 7, the metal plate 2 is the curved plate, and the plurality of resonant elements 1 is arranged on an identical curved surface.

In the metal plate 2 being the curved plate, the tips 11*b*, 12*b*, and 13*b* of the respective poles 11, 12, and 13 extend in mutually different directions on the identical curved surface. That is, the extending directions of the tips 11*b*, 12*b*, and 13*b* of the respective poles 11, 12, and 13 are shifted by 120 degrees from each other.

Note that the curved surface shape of the metal plate 2 illustrated in FIG. 7 is an example, and does not limit a curvature, eccentricity, and the like of the curved surface.

Figure 8A:
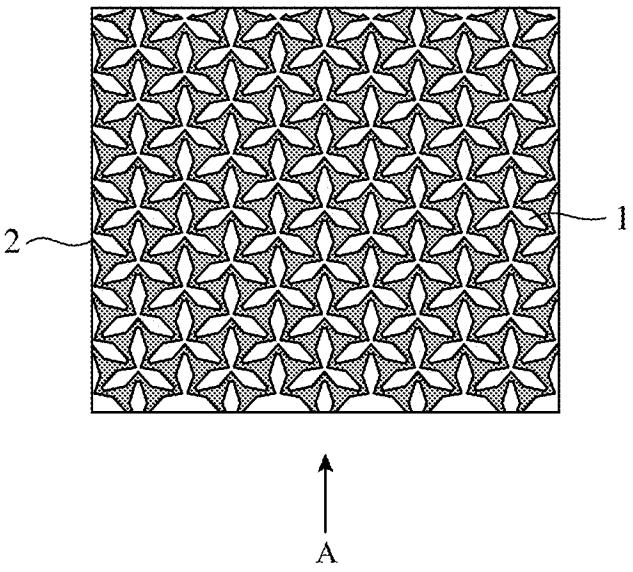
FIG. 8A is a diagram of a top view of a frequency selective surface according to the Embodiment 3 of the present invention.
Figure 8B:
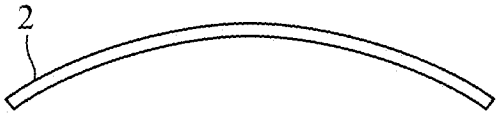
FIG. 8B is a diagram of a side view of the frequency selective surface according to the Embodiment 3 of the present invention.

Therefore, the plurality of resonant elements 1 may be arranged on the metal plate 2 having a curved surface shape as illustrated in FIG. 8. FIG. 8A is a diagram of a top view of a frequency selective surface according to the Embodiment 3 of the present invention, and FIG. 8B is a diagram of a side view of the frequency selective surface according to the Embodiment 3 of the present invention. FIG. 8B represents a side view as seen in the direction "A" illustrated in FIG. 8A.

The shape of the resonant element 1 is a wedge shape in which the central part 10 is constricted as illustrated in FIG. 1. Therefore, even when the plurality of resonant elements 1 is arranged on the identical curved surface, it is possible to densely arrange the plurality of resonant elements 1 to narrow the interval between the central parts 10, as in the foregoing Embodiments 1 and 2.

As a result, even when the incidence angle of the radio wave becomes large, it is possible to obtain a frequency selective surface capable of obtaining the transmission characteristic and the reflection characteristic over broadband.

Embodiment 4

In the foregoing Embodiments 1 to 3, the frequency selective surface has been described, in which the plurality of resonant elements 1 is periodically arranged. In Embodiment 4, a case will be described, in which the frequency selective surface shown in FIG. 2, 7 or 8, in which the plurality of resonant elements 1 is periodically arranged, is incorporated in an antenna device.

Figure 9:
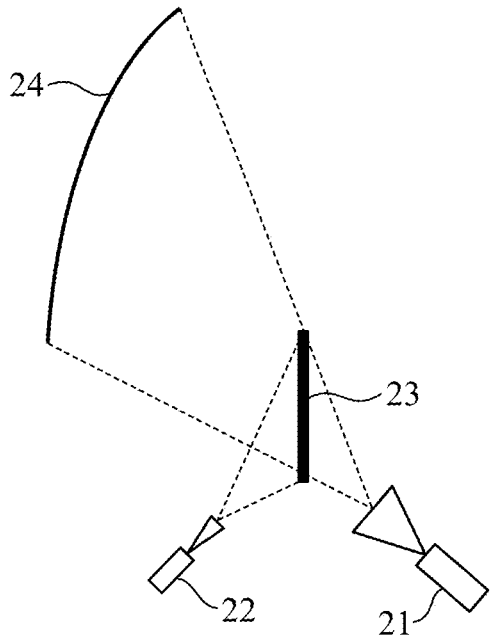
FIG. 9 is a structural diagram of an antenna device incorporating a frequency selective surface according to Embodiment 4 of the present invention.

FIG. 9 is a structural diagram of an antenna device incorporating a frequency selective surface according to the Embodiment 4 of the present invention.

The antenna device in FIG. 9 represents an example of an offset parabolic antenna in which the frequency selective surface is incorporated.

In FIG. 9, a primary radiator 21 is arranged at a position of the focal point of a main reflector 24. The primary radiator 21 is a radio wave oscillating source for radiating a radio wave of a frequency band f1.

A primary radiator 22 is arranged at a position of a mirror image of the focal point with respect to a frequency selective surface 23. The primary radiator 22 is a radio wave oscillating source for radiating a radio wave of a frequency band f2.

The frequency selective surface 23 is the frequency selective surface shown in FIG. 2. The frequency selective surface 23 transmits the radio wave of the frequency band f1 radiated from the primary radiator 21 and reflects the radio wave of the frequency band f2 radiated from the primary radiator 22. The frequency selective surface 23 may be the hole-type frequency selective surface or the patch-type frequency selective surface.

The main reflector 24 is a reflector for reflecting the radio wave of the frequency band f1 transmitted through the frequency selective surface 23 and reflecting the radio wave of the frequency band f2 reflected by the frequency selective surface 23.

Next, the operation will be described.

When the frequency selective surface 23 is, for example, the hole-type frequency selective surface, the lengths of the poles 11, 12, and 13 are designed such that the plurality of resonant elements 1 in the frequency selective surface 23 resonates with the radio wave of the frequency band f1 radiated from the primary radiator 21. That is, the lengths of the line segment RS, the line segment FT, and the line segment LU are designed. The resonance frequency of the resonant element 1 is determined by the lengths of the poles 11, 12, and 13.

In addition, the lengths of the poles 11, 12, and 13 are designed such that the plurality of resonant elements 1 in the frequency selective surface 23 does not resonate with the radio wave of the frequency band f2 radiated from the primary radiator 22.

Thus, the radio wave of the frequency band f1 radiated from the primary radiator 21 is transmitted through the frequency selective surface 23 and then reflected by the main reflector 24.

The radio wave of the frequency band f2 radiated from the primary radiator 22 is reflected by the frequency selective surface 23 in a direction where the main reflector 24 exists, and then reflected by the main reflector 24.

Note that, when the frequency selective surface 23 is the patch-type frequency selective surface, the lengths of the poles 11, 12, and 13 are designed such that the plurality of resonant elements 1 in the frequency selective surface 23 resonates with the radio wave of the frequency band f2 radiated from the primary radiator 22, but does not resonate with the radio wave of the frequency band f1 radiated from the primary radiator 21.

Although the antenna device for radiating the radio wave has been described, the antenna device may be an antenna device for receiving the radio wave.

In the case of the antenna device for receiving the radio wave, the radio wave of the frequency band f1 reflected by the main reflector 24 is transmitted through the frequency selective surface 23 and then received by the primary radiator 21.

In addition, the radio wave of the frequency band f2 reflected by the main reflector 24 is reflected by the frequency selective surface 23 in a direction in which the primary radiator 22 exists, and then received by the primary radiator 22.

In this case, the primary radiators 21 and 22 serve as receivers.

According to the Embodiment 4, it is possible to obtain an antenna device enabled to be commonly used for the frequency band f1 and the frequency band f2.

Note that, the frequency selective surface 23 is the frequency selective surface shown in FIG. 2 by which the broadband transmission characteristic and reflection characteristic can be obtained even when the incidence angle of the radio wave becomes large. Therefore, it is possible to suppress decrease in the gain within the frequency band even when the incidence angle of the radio wave is large.

In FIG. 9, the example of the offset parabolic antenna incorporating the frequency selective surface 23 is illustrated. Alternatively, as illustrated in FIG. 10, the frequency selective surface 23 may be incorporated as part of a focused beam power feeding system that is often used for an antenna device such as a reflector antenna for a large ground station.

Figure 10:
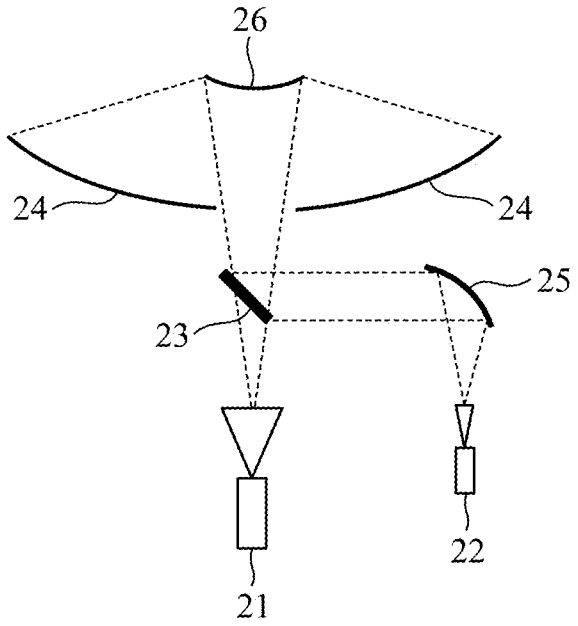
FIG. 10 is a structural diagram of an antenna device incorporating a frequency selective surface according to the Embodiment 4 of the present invention.

FIG. 10 is a structural diagram of an antenna device incorporating a frequency selective surface according to the Embodiment 4 of the present invention. In FIG. 10, since the same reference numerals as those in FIG. 9 denote the same or corresponding portions, the description thereof will be omitted.

A secondary curved mirror 25 is a reflector for reflecting the radio wave of the frequency band f2 radiated from the primary radiator 22. The primary radiator 22 is arranged at a position of the focal point of the secondary curved mirror 25.

A sub-reflector 26 is a reflector for reflecting the radio wave of the frequency band f1 transmitted through the frequency selective surface 23 toward the main reflector 24 and reflecting the radio wave of the frequency band f2 reflected by the frequency selective surface 23 toward the main reflector 24. The primary radiator 21 is arranged at a position of the focal point in the sub-reflector 26.

In the case of the antenna device of FIG. 10, similarly to the antenna device of FIG. 9, it is possible to obtain an antenna device commonly used for the frequency band f1 and the frequency band f2.

In the case of the antenna device of FIG. 10, the frequency selective surface 23 is the one shown in FIG. 2, by which the transmission characteristic and the reflection characteristic over broadband can be obtained even when the incidence angle of the radio wave becomes large. Therefore, it is possible to suppress decrease in the gain within the frequency band even when the incidence angle of the radio wave is large.

In the case of the antenna device of FIG. 10, similarly to FIG. 9, the antenna device is not limited to an antenna device for radiating the radio wave, but may be an antenna device for receiving the radio wave.

In FIG. 9, the antenna device includes the frequency selective surface 23 in which the plurality of resonant elements 1 is arranged on the metal plate 2 being a flat plate. Alternatively, as illustrated in FIG. 11, the antenna device may include a frequency selective surface 27 in which the plurality of resonant elements 1 is arranged on the metal plate 2 being a curved plate.

Figure 11:
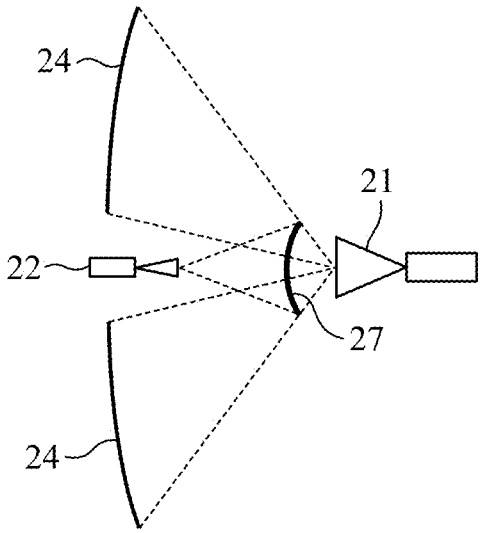
FIG. 11 is a structural diagram of an antenna device incorporating a frequency selective surface according to the Embodiment 4 of the present invention.

FIG. 11 is a structural diagram of an antenna device incorporating a frequency selective surface according to the Embodiment 4 of the present invention. In FIG. 11, since the same reference numerals as those in FIG. 9 denote the same or corresponding portions, the description thereof will be omitted.

The frequency selective surface 27 is the one shown in FIG. 7 or 8. The frequency selective surface 27 transmits the radio wave of the frequency band f1 radiated from the primary radiator 21 and reflects the radio wave of the frequency band f2 radiated from the primary radiator 22. The frequency selective surface 27 may be the hole-type frequency selective surface or the patch-type frequency selective surface.

The radio wave of the frequency band f1 radiated from the primary radiator 21 is transmitted through the frequency selective surface 27 and then reflected by the main reflector 24.

In addition, the radio wave of the frequency band f2 radiated from the primary radiator 22 is reflected by the frequency selective surface 27 in a direction in which the main reflector 24 exists, and then reflected by the main reflector 24.

In the case of the antenna device of FIG. 11, similarly to FIG. 9, it is possible to obtain an antenna device enabled to be commonly used for the frequency band f1 and the frequency band f2.

In the case of the antenna device of FIG. 11, the frequency selective surface 27 is the one shown in FIG. 7 or 8, by which the transmission characteristic and the reflection characteristic over broadband can be obtained even when the incidence angle of the radio wave becomes large. Therefore, it is possible to suppress decrease in the gain within the frequency band even when the incidence angle of the radio wave is large.

In the case of the antenna device of FIG. 11, similarly to FIG. 9, the antenna device is not limited to an antenna device for radiating the radio wave, but may be an antenna device for receiving the radio wave.

Embodiment 5

In the foregoing Embodiment 4, the antenna device includes the frequency selective surface 23 or 27, in which the plurality of resonant elements 1 is periodically arranged. In Embodiment 5, the frequency selective surface 23 or 27, on which the plurality of resonant elements 1 is periodically arranged, is arranged to cover all or part of the antenna.

Figure 12:
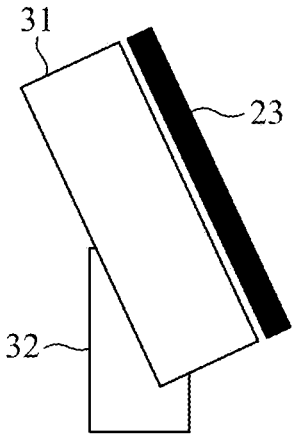
FIG. 12 is a structural diagram of an antenna device incorporating a frequency selective surface according to Embodiment 5 of the present invention.

FIG. 12 is a structural diagram of an antenna device incorporating a frequency selective surface according to the Embodiment 5 of the present invention. In FIG. 12, since the same reference numerals as those in FIG. 9 denote the same or corresponding portions, the description thereof will be omitted.

An antenna 31 is installed on an antenna supporting base 32, and transmits or receives a radio wave.

The antenna 31 may be, for example, an array antenna or a reflector antenna. The type of the antenna 31 is not limited to the array antenna or the reflector antenna, and any antenna may be used.

The antenna supporting base 32 is a base for supporting the antenna 31.

In the example of FIG. 12, the frequency selective surface 23 is arranged to cover the front surface being part of the antenna 31.

The frequency selective surface 23 is the one shown in FIG. 2, by which the transmission characteristic and the reflection characteristic over broadband can be obtained even when the incidence angle of the radio wave becomes large. Therefore, it is possible to suppress decrease in the gain within the frequency band even when the incidence angle of the radio wave received by the antenna 31 is large, or even when an outgoing angle of the radio wave radiated from the antenna 31 is large.

The antenna device has been described, in which the frequency selective surface 23 is arranged to cover the front surface of the antenna 31. Alternatively, as illustrated in FIG. 13, the frequency selective surface 27 may be arranged to cover all the antenna 31.

Figure 13:
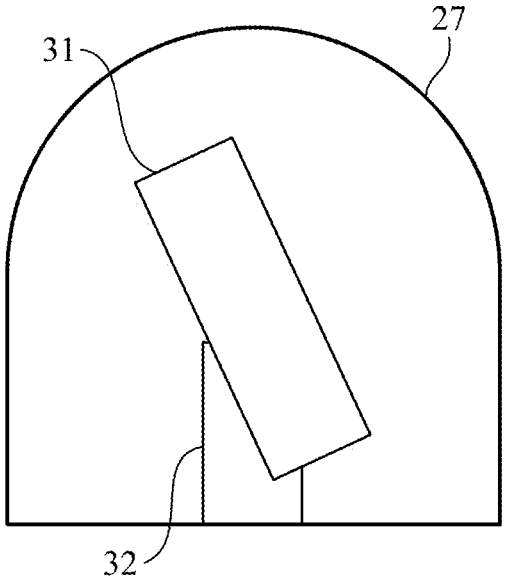
FIG. 13 is a structural diagram of an antenna device incorporating a frequency selective surface according to the Embodiment 5 of the present invention.

FIG. 13 is a structural diagram of an antenna device incorporating a frequency selective surface according to the Embodiment 5 of the present invention. In FIG. 13, since the same reference numerals as those in FIGS. 11 and 12 denote the same or corresponding portions, the description thereof will be omitted.

The frequency selective surface 27 is the one shown in FIG. 7 or 8, by which the transmission characteristic and the reflection characteristic over broadband can be obtained even when the incidence angle of the radio wave becomes large. Therefore, it is possible to suppress decrease in the gain within the frequency band even when the incidence angle of the radio wave received by the antenna 31 is large, or even when an outgoing angle of the radio wave radiated from the antenna 31 is large.

Note that, in the invention of the present application, within the scope of the invention, free combination of each embodiment, a modification of an arbitrary component of each embodiment, or omission of an arbitrary component in each embodiment is possible.

The present invention is suitable for a frequency selective surface used as a spatial filter and a resonant element used for the frequency selective surface.

REFERENCE SIGNS LIST

1: Resonant element, 1*a*/1*b*/1*c*: Central axis, 2: Metal plate, 10: Central part of resonant element, 11: Pole, 11*a*: Root, 11*b*: Tip, 12: Pole, 12*a*: Root, 12*b*: Tip, 13: Pole, 13*a*: Root, 13*b*: Tip, 21/22: Primary radiator, 23: Frequency selective surface, 24: Main reflector, 25: Secondary curved mirror, 26: Sub-reflector, 27: Frequency selective surface, 31: Antenna, 32: Antenna supporting base

The invention claimed is:

1. A resonant element of a frequency selective surface, comprising:

a plurality of poles whose roots are electrically connected to a central part and whose tips extend in mutually different directions on an identical plane or on an identical curved surface, wherein a pole width at each of the roots is narrower than a pole width at any point between each of the roots and the corresponding one of the tips, and a pole width at each of the tips is narrower than the pole width between each of the roots and the corresponding one of the tips, each pole width being defined by a length of a line segment in a direction perpendicular, on the identical plane or on the identical curved surface, to another line segment connecting each of the roots to a corresponding one of the tips in the respective poles;

wherein the plurality of poles of the resonant element include three poles disposed symmetrically to each other.

2. A frequency selective surface comprising:

a plurality of resonant elements arranged in the frequency selective surface, each of the resonant elements having a plurality of poles whose roots are electrically connected to a central part and whose tips extend in mutually different directions on an identical plane or on an identical curved surface, wherein each of the plurality of resonant elements is shaped such that a pole width at each of the roots is narrower than a pole width at any point between each of the roots and the corresponding one of the tips, and a pole width at each of the tips is narrower than the pole width between each of the roots and the corresponding one of the tips, each pole width being defined by a length of a line segment in a direction perpendicular, on the identical plane or on the identical curved surface, to another line segment connecting each of the roots to a corresponding one of the tips in the respective poles, and wherein an arrangement pattern of the plurality of resonant elements is formed such that, when attention is paid to two resonant elements which are arranged adjacent to each other in the plurality of resonant elements, a tip of one of the poles in one of the two resonant elements is close to the central part of another one of the two resonant elements within a range not contacting said another one of the two resonant elements;

wherein the plurality of poles of the respective resonant elements include three poles disposed symmetrically to each other.

3. An antenna device comprising:

a frequency selective surface on which a plurality of resonant elements resonating with a radio wave are arranged, wherein each of the resonant elements has a plurality of poles whose roots are electrically connected to a central part and whose tips extend in mutually different directions on an identical plane or on an identical curved surface, each of the plurality of resonant elements is shaped such that a pole width at each of the roots is narrower than a pole width at any point between each of the roots and the corresponding one of the tips, and a pole width at each of the tips is narrower than the pole width between each of the roots and the corresponding one of the tips, each pole width being defined by a length of a line segment in a direction perpendicular, on the identical plane or on the identical curved surface, to another line segment connecting each of the roots to a corresponding one of the tips in the respective poles, and an arrangement pattern of the plurality of resonant elements is formed such that, when attention is paid to two resonant elements which are arranged adjacent to each other in the plurality of resonant elements, a tip of one of the poles in one of the two resonant elements is close to the central part of another one of the two resonant elements within a range not contacting said another one of the two resonant elements;

wherein the plurality of poles of the respective resonant elements include three poles disposed symmetrically to each other.

4. The antenna device according to claim 3, further comprising a reflector configured to reflect the radio wave, wherein each of the plurality of resonant elements resonating with the radio wave reflected by the reflector or another radio wave radiated toward the reflector.

5. The antenna device according to claim 3, further comprising an antenna configured to transmit or receive the radio wave, wherein the frequency selective surface is installed at a position to cover all or part of the antenna.

* * * * *